US007013611B2

(12) United States Patent
Ramon-Borja

(10) Patent No.: US 7,013,611 B2
(45) Date of Patent: Mar. 21, 2006

(54) TILE SIMULATING FOUR TILES WITH A RETICULATED MESH SUPPORT AND FREE ASSEMBLY

(76) Inventor: Pablo Casanova Ramon-Borja, Ctra Lliria to Petrabla, Km.3, E-46160, Valencia (ES)

( * ) Notice: Subject to any disclaimer, the term of this patent is extended or adjusted under 35 U.S.C. 154(b) by 0 days.

(21) Appl. No.: 09/985,961

(22) Filed: Nov. 5, 2001

(65) Prior Publication Data

US 2002/0100237 A1 Aug. 1, 2002

Related U.S. Application Data

(63) Continuation of application No. PCT/ES01/00082, filed on Mar. 5, 2001.

(30) Foreign Application Priority Data

Mar. 6, 2000 (ES) ..... 200000590 U

(51) Int. Cl.
*E44F 7/00* (2006.01)
*E44F 9/00* (2006.01)
*E04C 1/00* (2006.01)

(52) U.S. Cl. ..... 52/314; 52/518; 52/542

(58) Field of Classification Search ..... 52/314, 52/518, 542, 535

See application file for complete search history.

(56) References Cited

FOREIGN PATENT DOCUMENTS

| | | | | |
|---|---|---|---|---|
| DE | 3301273 A1 * | 7/1984 | ..... | 52/518 |
| EP | 0695839 A1 | 7/1995 | | |
| ES | 261145 | 10/1981 | | |
| ES | 1043085 | 11/1999 | | |
| FR | 1087801 | 3/1955 | | |
| FR | 2263352 | 10/1975 | | |
| FR | 2705713 A1 * | 12/1994 | ..... | 52/518 |
| JP | 402232453 A * | 9/1990 | ..... | 52/518 |
| JP | 402232454 A * | 9/1990 | ..... | 52/518 |
| WO | PCT/AT95/00146 | 7/1995 | | |

* cited by examiner

*Primary Examiner*—Carl D. Friedman
*Assistant Examiner*—Nahid Amiri
(74) *Attorney, Agent, or Firm*—Penrose Lucas Albright

(57) ABSTRACT

A roofing tile simulates four S-shaped roof tiles, two side-by-side on top and the other two side-by-side below the first two simulated tiles. Two semi-cylindrical areas are longitudinally adjacent channel concave areas. The tile's front edge has protruding peripheral step. At its rear, the tile has horizontal channel zones which are slightly lower in height with respect to the rest of the tile and includes a posterior peripheral ridge. The front edge is cut back for both concave simulated portions and support sections are provided for the tiles whereby the tile defines an air chamber to form better thermal and acoustic insulation.

9 Claims, 7 Drawing Sheets

TILE SIMULATING FOUR TILES WITH A RETICULATED MESH SUPPORT AND FREE ASSEMBLY

RELATED APPLICATION

This application is a continuation of International Application No. PCT/ES01/00082, filed Mar. 5, 2001.

FIELD OF THE INVENTION

This invention relates to a roof tile that simulates four tiles with a reticulated mesh support and free assembly whereby placement of one unit has the effect of placing four single tiles.

BACKGROUND OF THE INVENTION

Roof tiles composed of glazed and unglazed fired clay were used in ancient Greece and Rome. Red and orange clay roof tile continues to be widely used in Southern Europe. Two common systems for the roof tiles comprises an underlayer of concave tiles covered at the joint by an outer layer of convex tiles, and overlapping S-shaped tiles.

SUMMARY OF THE INVENTION

The effect achieved in the invention is that of two ridge tiles and two channel tiles, all adjacent to each other are combined into a single tile unit. The channel tiles are concave shaped on the upper face although the bottom face support is flat and mesh-shaped.

Although advantages of this invention may be appreciated from the following description, they include, without any limitation the following, related in particular to the support provided in the shape of reticulate mesh.

Ventilation of the bottom face on the tile on the roof is facilitated while leaving some airtight compartments in the shape of air chambers. Good ventilation is necessary in ceramic material. Dampness and condensations are avoided and better quality and durability is achieved in the covering, both in the support and tiles.

The air chamber so provided contributes to better thermal and acoustic insulation.

The horizontal support which is provided gives better stability for its placement on the roof.

Greater adherence to the support, facilitates the fastening of the tiles.

The mesh support facilitates manufacturing the tiles in series, given that it improves the airing of the tiles in both the drying room and the kiln.

Because of the horizontal support, this tile can be manufactured in the same tray as standard tiles.

The support is reinforced with ribs, which provide greater rigidity, resistance to flexopressure compression and impact. Free assembly allows for the following advantages:

Greater speed and velocity of placement.

The possibility of laying the tiles on the roofs in shifting squares or circularly.

Dry finishing at the roof (without mortar).

BRIEF DESCRIPTION OF THE DRAWINGS

For a better understanding of the invention the following drawings are included, which serve as a non-limiting example of the invention, in which.

DETAILED DESCRIPTION OF THE PREFERRED EMBODIMENTS

Figure 1:
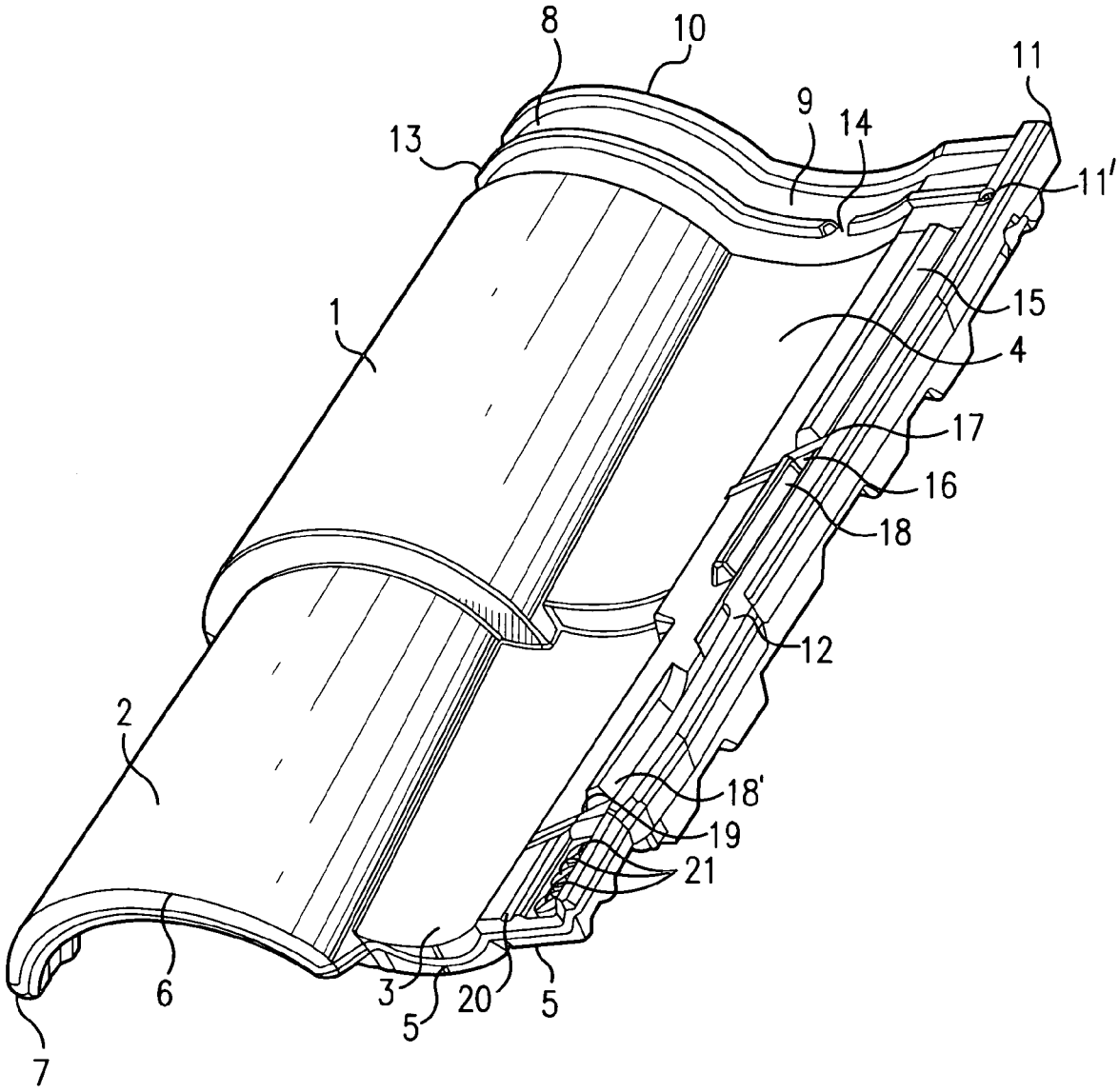
FIG. 1 is a perspective view of the top face of the tile.

In accordance with this invention, the tile consists of two semi-cylindrical areas 1 and 2 which are convexed superimposed, and longitudinally adjacent with channeled concave areas 3 and 4 which are superimposed as well. The latter have a flat bottom support 5. The front edge 6 at the lower end of the tile has a protruding peripheral step 7. At its upper end, the tile has convex 8 and concave 9 channel zones slightly lower in height with respect to the rest of the tile with a posterior peripheral first step 10 that ends in a second step comprising a longitudinal edge 11 and undercut outboard upper edge 11'. At a level where the superimposition of the tiles is simulated (where concave areas 3 and 4 join), there is an undercutting or descending step 12.

In the middle of the width of channel 8, there is a third step 13 similar in height and parallel to the peripheral first step 10. The former has a channel 14 in the center of the concave area 9. Components 8–10 and 13 are the support means to receive the lower edge of the next higher tile whereas the components 11, 11', 15, 18 and 18' are support means for the adjoining tile along longitudinal edge 11. In its entirety, the support means has a general configuration of an inverse "L". A fourth step 15 which has a trapezoid cross-section is inboard of longitudinal edge 11 and undercut 11'. Farther down the natural decline of tile edge 11 and undercut 11' is the descending fifth step at 12 as indicated above. A sixth step is at 18' inboard of edge 11 and undercut 11'.

At the same time, on the inside of the peripheral longitudinal step 11 there is another step with a trapezoidal section with an appropriate length of two-thirds of the adjacent concave area length.

Next to it there is a channel 16 with a slight transversal protrusion 17.

There is another longitudinal protrusion 18 with a trapezoidal section of shorter length which reaches the zone that simulates the superimposition of the tiles where the peripheral edge presents a descending step 12 which has been previously mentioned. Inside there is another step 18' similar to those previously described, and of a greater height at the peripheral edge, thus creating a slight oblique transversal rim 19.

The front part of this flat zone is divided longitudinally by the channel 20 and the most outer part is composed of three oblique steps 21 which are parallel to each other.

On the bottom face, the concave area as well as the flat periphery have lugs with a trapezoidal section which serves as a support on the cover.

Figure 2:
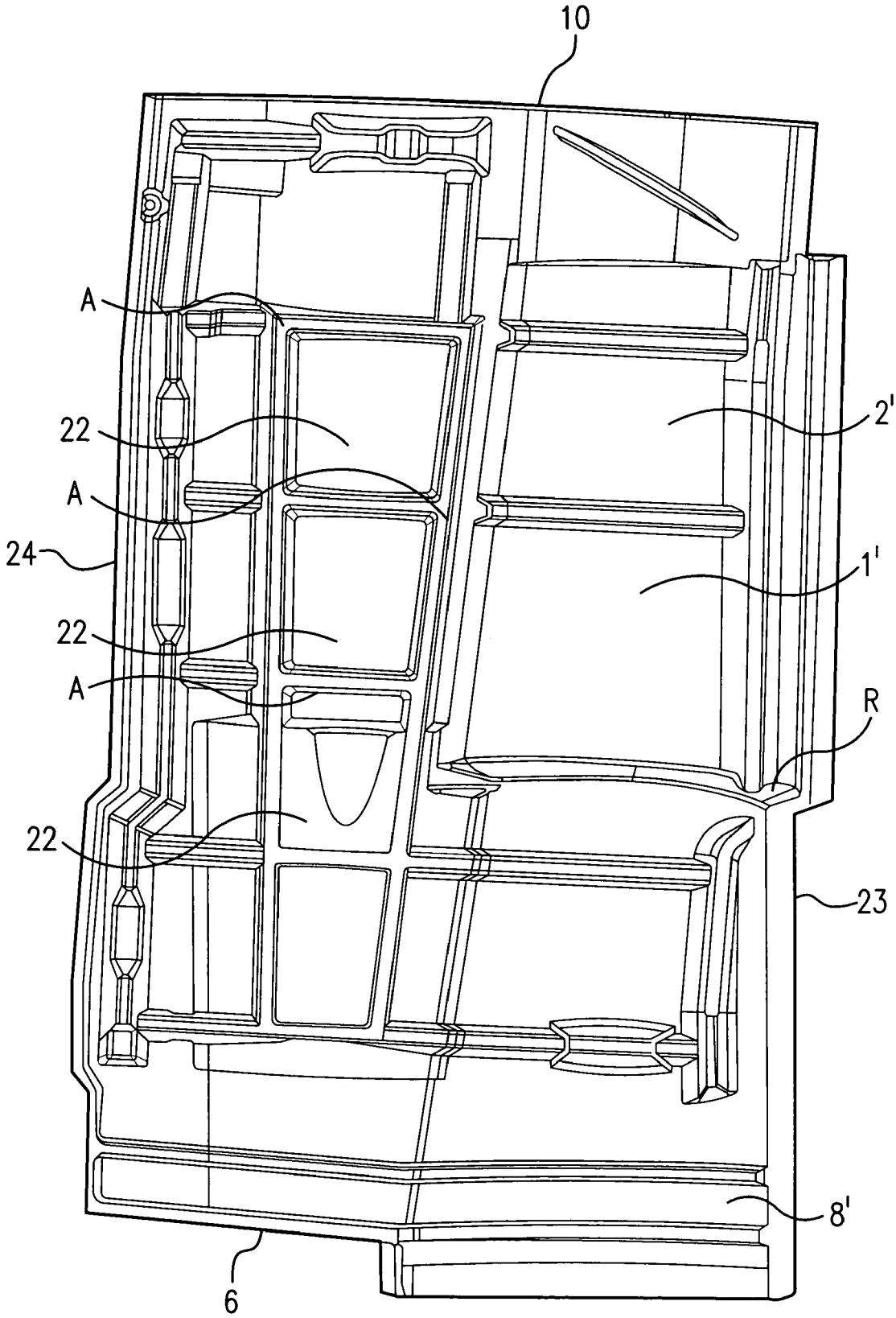
FIG. 2 is a view of the bottom face of the tile in relief.
Figure 3:
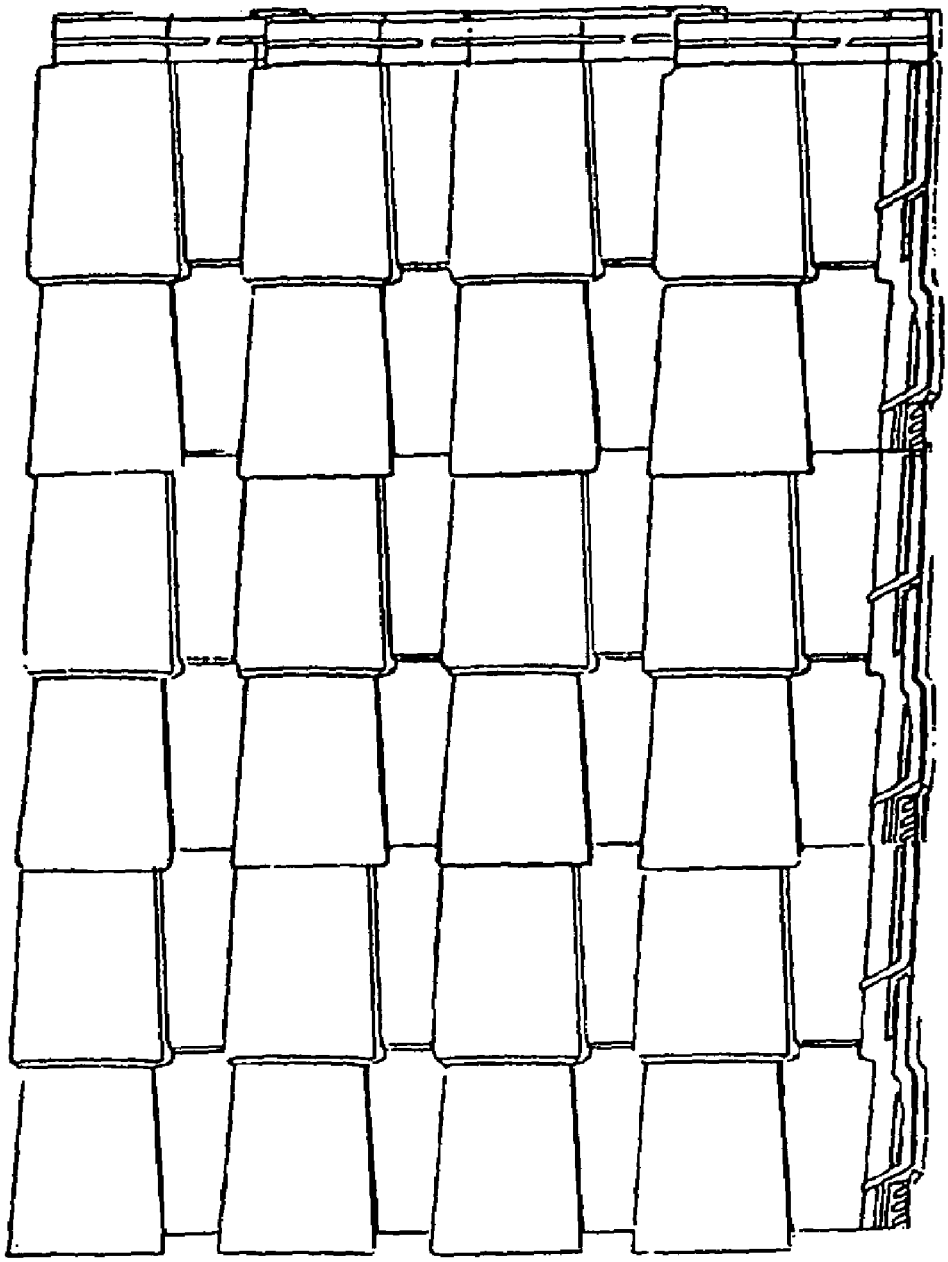
FIG. 3 is an elevated plan view of a cover wherein a plurality of tiles has been assembled.
Figure 4:
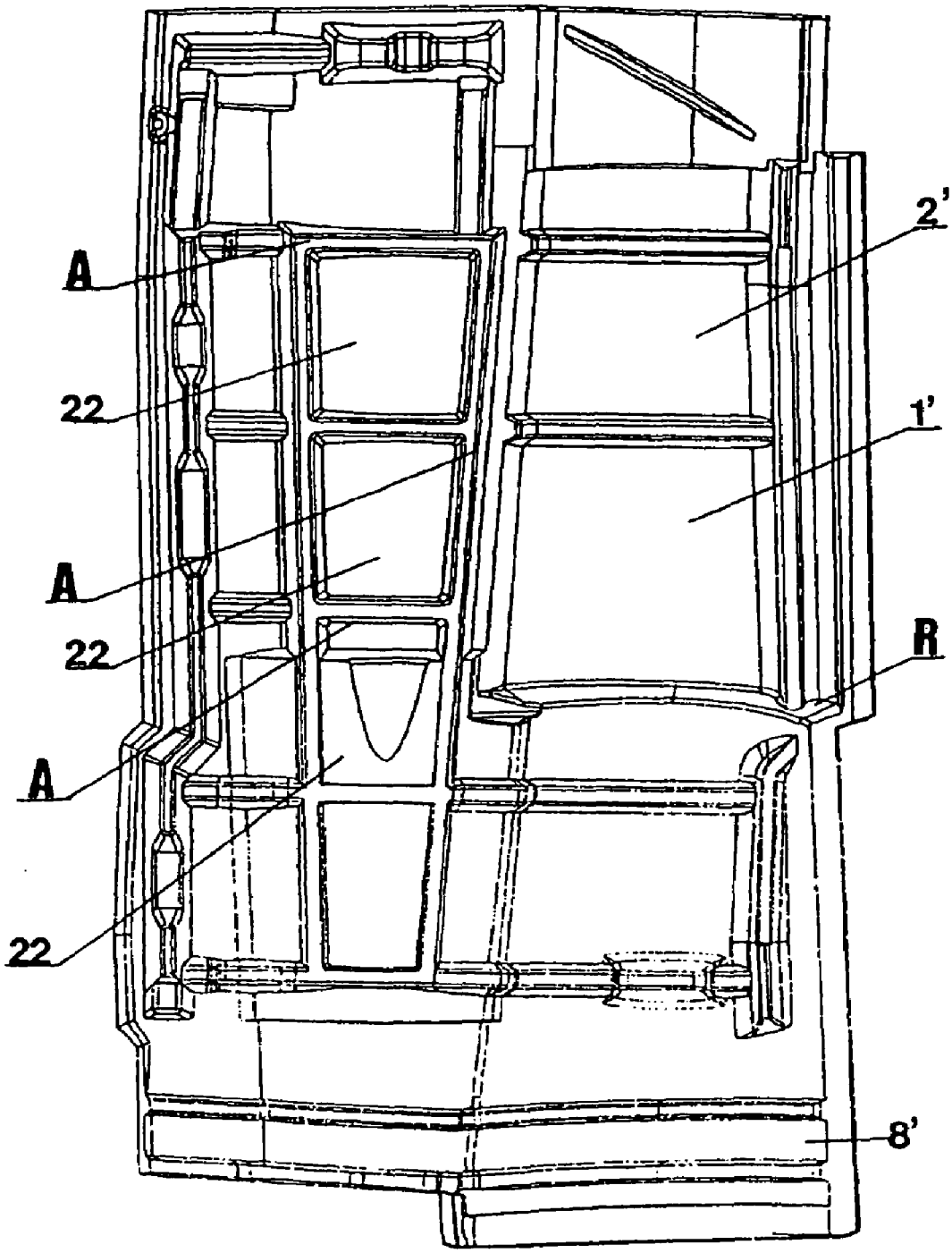
FIG. 4 is a view of the bottom face of the tile in relief.
Figure 5:
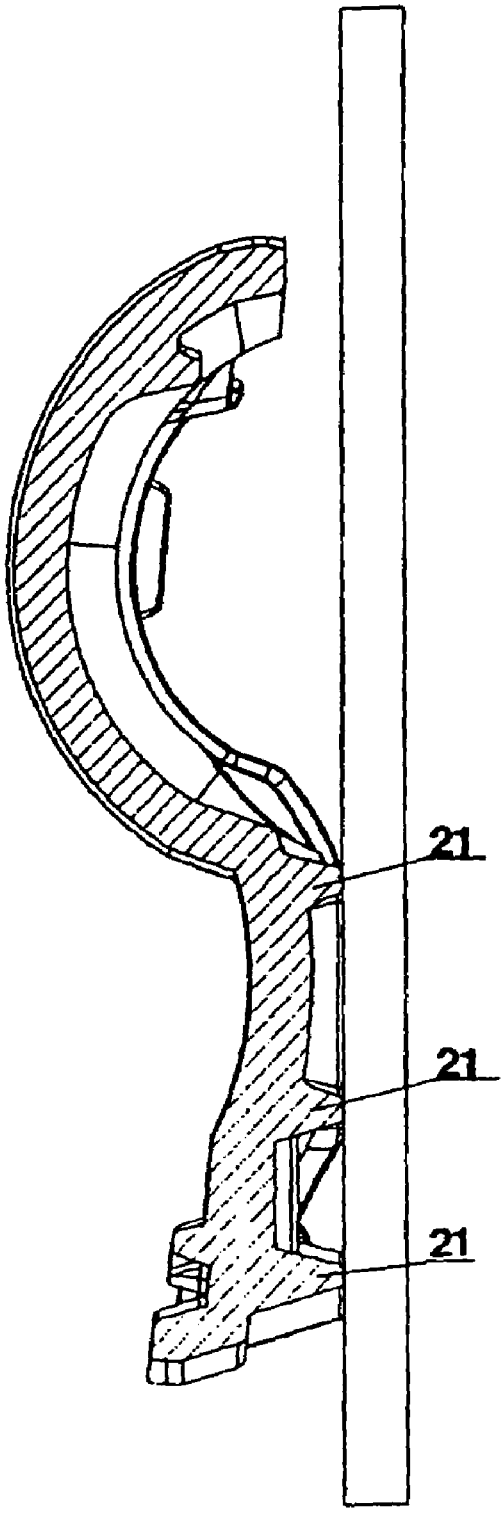
FIG. 5 is a side section view of the tile.
Figure 6:
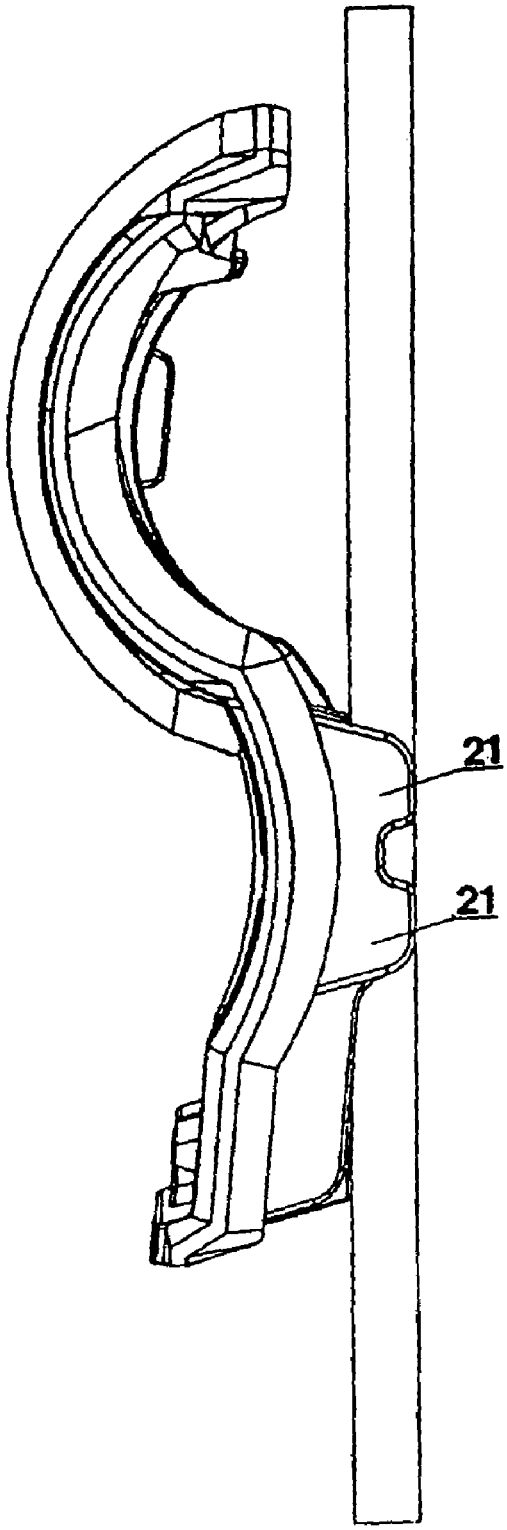
FIG. 6 is the side section of an assembled tile.
Figure 7:
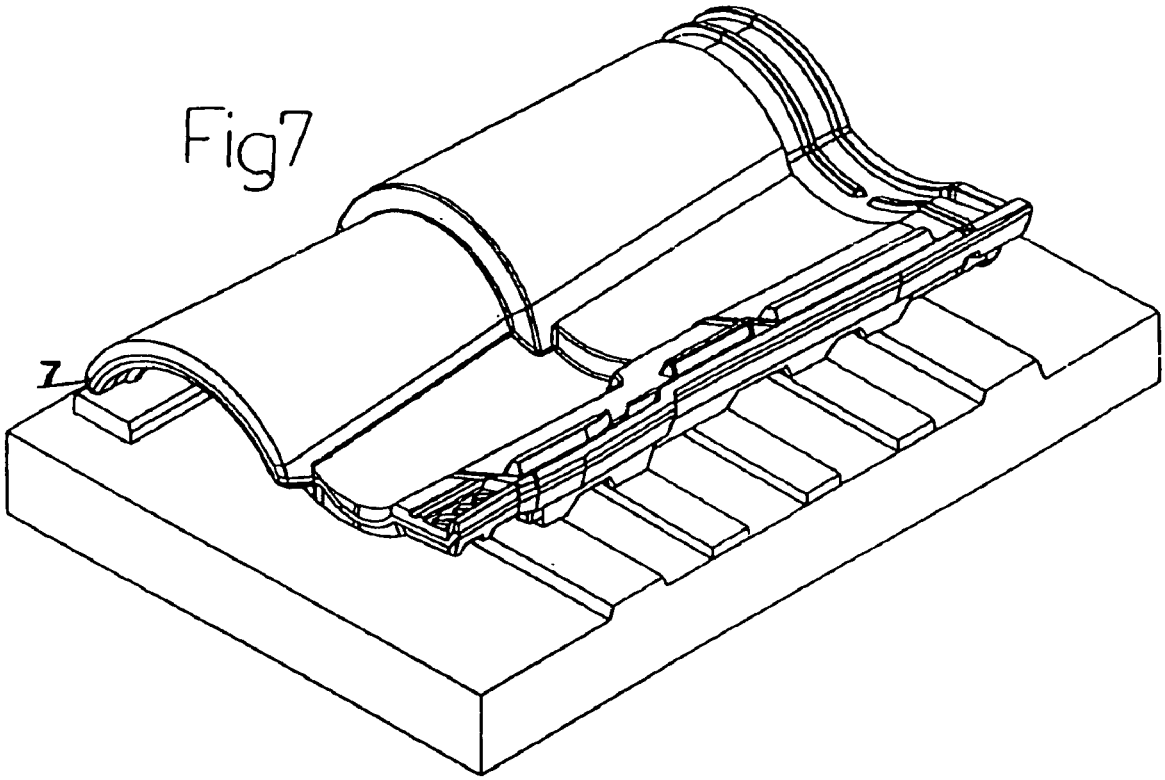
FIG. 7 is a respective view of the tile as it is being manufactured in a tray.
Figure 8:
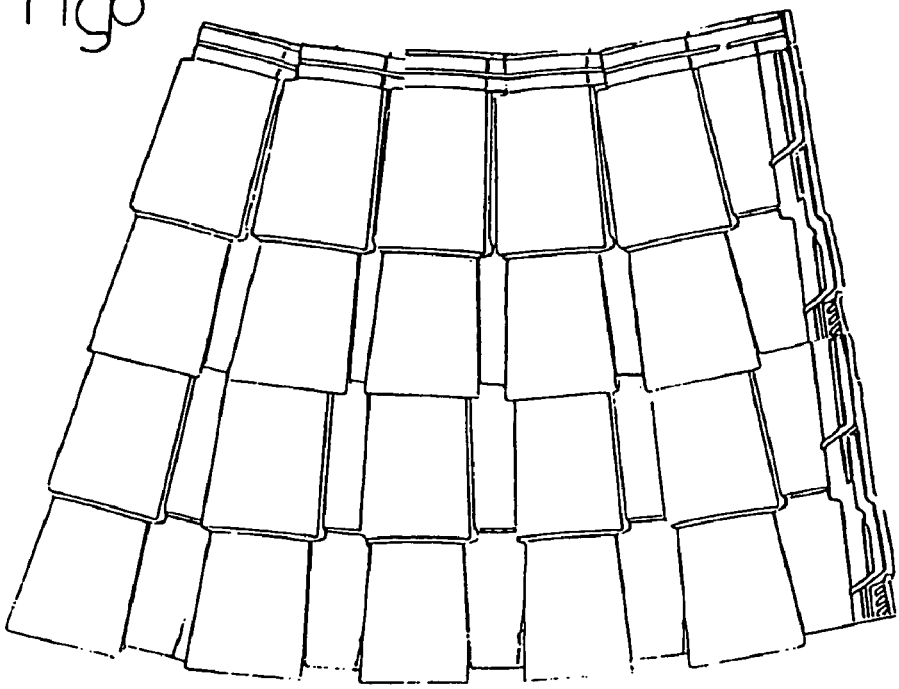
FIG. 8 is a view of tiles in a circular cover.

FIG. 2 shows a bottom view with peripheral release R of flat areas 1' and 2' which correspond to the bottom face of the convex areas that serve as support to the latter. As seen in FIG. 2, the tile is defined by an upper edge and peripheral ridge 10, a lower first edge 6 and connecting means for such edges comprising longitudinal sides 23 and 24.

The areas which are on the top face are concave and flat to form a mesh with supports in the peripheral ribs A and trapezoid spaces 22 determined by the ribs which allow the support of the edges in the ribs that protrude as well as for the creation of air chambers which improve ventilation and avoid dampness.

Although I have disclosed the preferred embodiments of my invention, it is to be understood that it is capable of other adaptations and modifications within the scope of the following claims:

Having thus disclosed my invention, what I claim as new and to be secured by Letters Patent of the United States of America is:

1. A tile simulating four tiles with a reticulated mesh support and free assembly which comprises: an upper end and a lower end which are connected by longitudinal edges to define the tile; said upper end comprising connecting means for being connected to the lower end of an adjacent tile, support means being provided along at least one of said longitudinal edges; two upper simulated tile areas and two lower simulated tile areas, both of said simulated tile areas opposite said longitudinal edge having said support means being convex and said two of said simulated tile areas adjacent said longitudinal edge having said support means being concave, each of said simulated tiles having a trapezoid configuration as seen in plan, a generally flat area extending longitudinally between said concave simulated tiles and said longitudinal edge having said support means, said flat area adapted to receive an outboard longitudinal edge of said two convex simulated tiles of an adjoining tile; channel means being provided obliquely across said flat area to guide fluid flow from adjacent said longitudinal edge having said support means to the respective concave simulated tiles.

2. A tile in accordance with claim 1, wherein as seen in plan the widths of said convex simulated tiles are at least approximately twice the widths of said concave simulated tiles.

3. A tile in accordance with claim 1, wherein the upper of said simulated tiles are offset upwardly relative to the lower of said simulated tiles.

4. A tile in accordance with claim 1, wherein said simulated tiles each contain dead air compartments.

5. A tile in accordance with claim 1, wherein the undersides of said simulated tiles comprise peripheral ribs.

6. A tile in accordance with claim 5, wherein said peripheral ribs define between them trapezoid shaped spaces.

7. A tile in accordance with claim 1, wherein the undersides of said convex simulated tiles are provided with peripheral relief means.

8. A tile in accordance with claim 1, wherein said connecting means comprises at least one channel which is adapted to receive at least one protrusion at the underside of the lower said end of an adjoining tile.

9. A tile simulating four tiles with a reticulated mesh support and free assembly which comprises: upper and lower ends and lateral sides defining the tile; convex and concave channel zones having a peripheral posterior first step which ends in a peripheral edge comprising a longitudinal ridge second step that includes an undercut outboard upper edge; a third step which is parallel to said first step and which is provided with a channel at the center of said concave channel zone; a fourth step inboard of said second step having a trapezoidal section through which a trapezoidal channel is formed which extends obliquely and inclined downwardly, a longitudinal protrusion having a trapezoidal section which is between the lower of said concave channel zone and inboard of said longitudinal ridge; a descending fifth step in said longitudinal ridge laterally adjacent where said upper and lower concave channel zones join and inboard of said longitudinal ridge, and a flat zone provided longitudinally proximate to the lower end of said concave channel zone which includes a plurality of parallel oblique steps.

* * * * *